US006198410B1

(12) United States Patent
White et al.

(10) Patent No.: US 6,198,410 B1
(45) Date of Patent: Mar. 6, 2001

(54) ILLUMINATABLE TRAFFIC SIGN

(76) Inventors: Larry White; Dorothy White, both of 414 Connor Rd., Oxford, PA (US) 19363

( * ) Notice: Subject to any disclaimer, the term of this patent is extended or adjusted under 35 U.S.C. 154(b) by 0 days.

(21) Appl. No.: 09/416,682

(22) Filed: Oct. 12, 1999

(51) Int. Cl.[7] ..... G08G 1/01

(52) U.S. Cl. ..... 340/907; 340/916; 340/917; 340/919; 340/933

(58) Field of Search ..... 340/907, 909, 340/916, 917, 919, 933, 935, 941, 943

(56) References Cited

U.S. PATENT DOCUMENTS

| | | | | |
|---|---|---|---|---|
| D. 315,695 | | 3/1991 | DeCaro | D10/114 |
| D. 351,807 | | 10/1994 | Smith et al. | D10/109 |
| D. 382,218 | | 8/1997 | Hall | D10/109 |
| 3,593,448 | | 7/1971 | Schoepf | 40/132 |
| 3,818,430 | * | 6/1974 | Williams | 340/38 |
| 3,863,206 | * | 1/1975 | Rabie | 340/38 |
| 4,038,633 | * | 7/1977 | King | 340/38 |
| 4,131,848 | * | 12/1978 | Battle | 324/236 |
| 4,370,718 | * | 1/1983 | Chasek | 364/436 |
| 4,907,139 | * | 3/1990 | Quiogue | 362/153 |
| 4,908,615 | * | 3/1990 | Bayraktaroglu | 340/917 |
| 5,041,828 | * | 8/1991 | Loeven | 340/937 |
| 5,057,831 | * | 10/1991 | Strang et al. | 340/941 |
| 5,276,424 | * | 1/1994 | Hegemann | 340/321 |
| 5,307,272 | * | 4/1994 | Butler et al. | 364/424.02 |
| 5,371,489 | | 12/1994 | Carroll et al. | 340/565 |
| 5,448,219 | * | 9/1995 | Yoshikawa et al. | 340/436 |
| 5,497,148 | * | 3/1996 | Oliva | 340/905 |
| 5,598,066 | | 1/1997 | Wiesemann et al. | 315/159 |
| 5,606,309 | * | 2/1997 | Smith | 340/473 |
| 5,634,287 | * | 6/1997 | Lamparter | 40/572 |
| 5,652,577 | * | 7/1997 | Frasier | 340/933 |
| 5,654,705 | * | 8/1997 | Houten et al. | 340/944 |
| 5,660,453 | * | 8/1997 | Lewis | 362/32 |
| 5,755,051 | * | 5/1998 | Zumbuhl | 40/586 |
| 5,819,455 | * | 10/1998 | Tsuda | 40/580 |
| 5,821,853 | * | 10/1998 | Gustavson et al. | 340/468 |
| 5,844,502 | * | 12/1998 | Perez et al | 340/941 |
| 5,959,554 | * | 9/1999 | Armstrong | 340/908 |
| 6,009,650 | * | 1/2000 | Lamparter | 40/572 |

* cited by examiner

*Primary Examiner*—Jeffery Hofsass
*Assistant Examiner*—Son M. Tang
(74) *Attorney, Agent, or Firm*—Goldstein & Canino

(57) ABSTRACT

An illuminatable traffic sign including a traffic sign secured to a support post. The traffic sign has indicia disposed thereon. The traffic sign has an outer periphery. A plurality of lights are positioned on the traffic sign along the outer periphery and outlining the indicia thereof.

3 Claims, 2 Drawing Sheets

ILLUMINATABLE TRAFFIC SIGN

BACKGROUND OF THE INVENTION

The present invention relates to an illuminatable traffic sign and more particularly pertains to lighting a traffic sign at night and upon the approach of a vehicle.

The use of traffic signs is known in the prior art. More specifically, traffic signs heretofore devised and utilized for the purpose of controlling traffic are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,598,066 to Wiesemann et al. discloses a two-level security lighting system. U.S. Pat. No. 5,371,489 to Carroll et al. discloses a motion sensing and light flashing apparatus. U.S. Pat. No. 3,593,448 to Schoepf et al. discloses an internally lighted, overhead, traffic sign for streets and highways. U.S. Pat. No. Des. 351,807 to Smith et al. discloses the ornamental design for an illuminated hand-held stop sign. U.S. Pat. No. Des. 315,695 to DeCaro discloses the ornamental design for an illuminated changeable warning signal. U.S. Pat. No. Des. 382,218 to Hall discloses the ornamental design for a hand held stop sign.

While these devices fulfill their respective, particular objective and requirements, the aforementioned patents do not describe an illuminatable traffic sign for lighting a traffic sign at night and upon the approach of a vehicle.

In this respect, the illuminatable traffic sign according to the present invention substantially departs from the conventional concepts and designs of the prior art, and in doing so provides an apparatus primarily developed for the purpose of lighting a traffic sign at night and upon the approach of a vehicle.

Therefore, it can be appreciated that there exists a continuing need for a new and improved illuminatable traffic sign which can be used for lighting a traffic sign at night and upon the approach of a vehicle. In this regard, the present invention substantially fulfills this need.

SUMMARY OF THE INVENTION

In the view of the foregoing disadvantages inherent in the known types of traffic signs now present in the prior art, the present invention provides an improved illuminatable traffic sign. As such, the general purpose of the present invention, which will be described subsequently in greater detail, is to provide a new and improved illuminatable traffic sign and method which has all the advantages of the prior art and none of the disadvantages.

To attain this, the present invention essentially comprises a traffic sign secured to a support post. The traffic sign has indicia disposed thereon. The traffic sign has an outer periphery. A plurality of lights are positioned on the traffic sign along the outer periphery and outlining the indicia thereof. A photo cell is disposed within the traffic sign. The photo cell is in communication with the plurality of lights. A radar sensor is disposed within the traffic sign. The radar sensor is in communication with the plurality of lights. The radar sensor is equipped with a metal detecting system.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminatable traffic sign which has all the advantages of the prior art traffic signs and none of the disadvantages.

It is another object of the present invention to provide a new and improved illuminatable traffic sign which may be easily and efficiently manufactured and marketed.

It is a further object of the present invention to provide a new and improved illuminatable traffic sign which is of durable and reliable construction.

An even further object of the present invention is to provide a new and improved illuminatable traffic sign which is susceptible of a low cost of manufacture with regard to both materials and labor, and which accordingly is then susceptible of low prices of sale to the consuming public, thereby making such an illuminatable traffic sign economically available to the buying public.

Even still another object of the present invention is to provide a new and improved illuminatable traffic sign for lighting a traffic sign at night and upon the approach of a vehicle.

Lastly, it is an object of the present invention to provide a new and improved illuminatable traffic sign including a traffic sign secured to a support post. The traffic sign has indicia disposed thereon. The traffic sign has an outer periphery. A plurality of lights are positioned on the traffic sign along the outer periphery and outlining the indicia thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
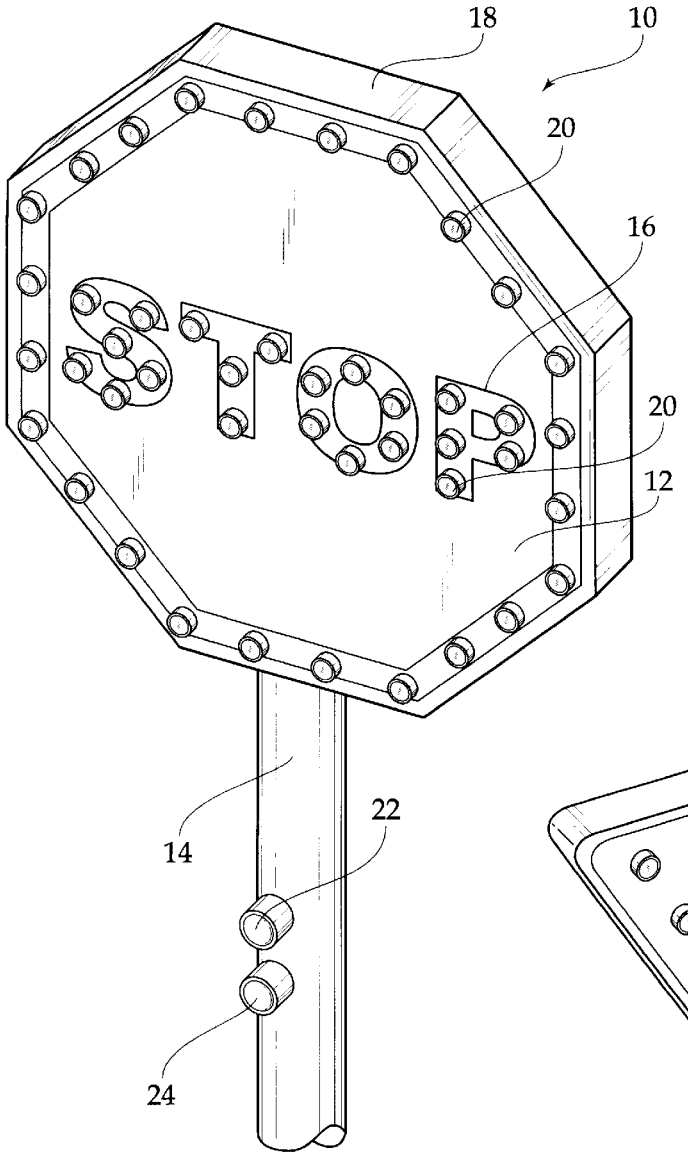
FIG. 1 is a perspective view of the preferred embodiment of the illuminatable traffic sign constructed in accordance with the principles of the present invention illustrated as a stop sign.
Figure 2:
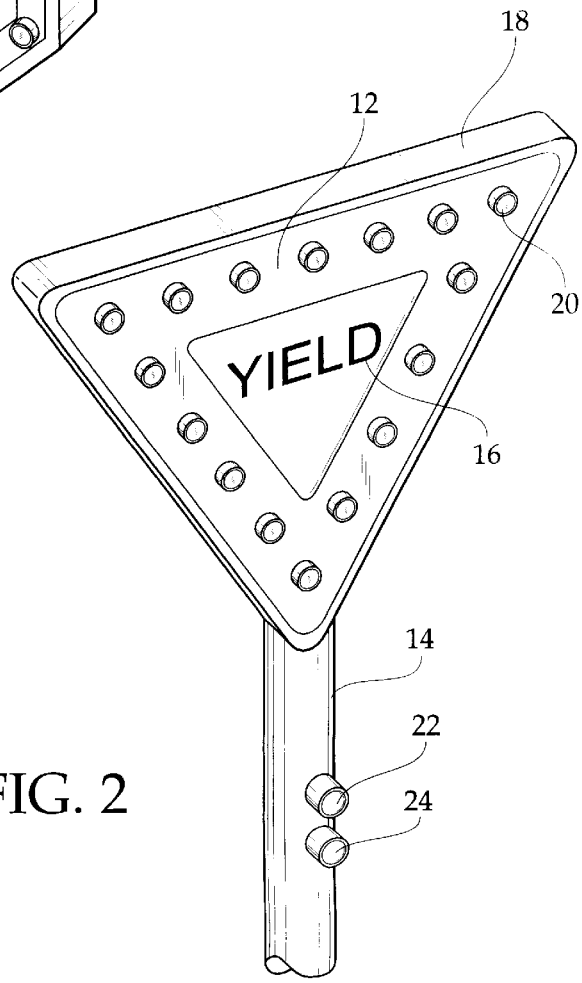
FIG. 2 is a perspective view of the present invention illustrated as a yield sign.
Figure 3:
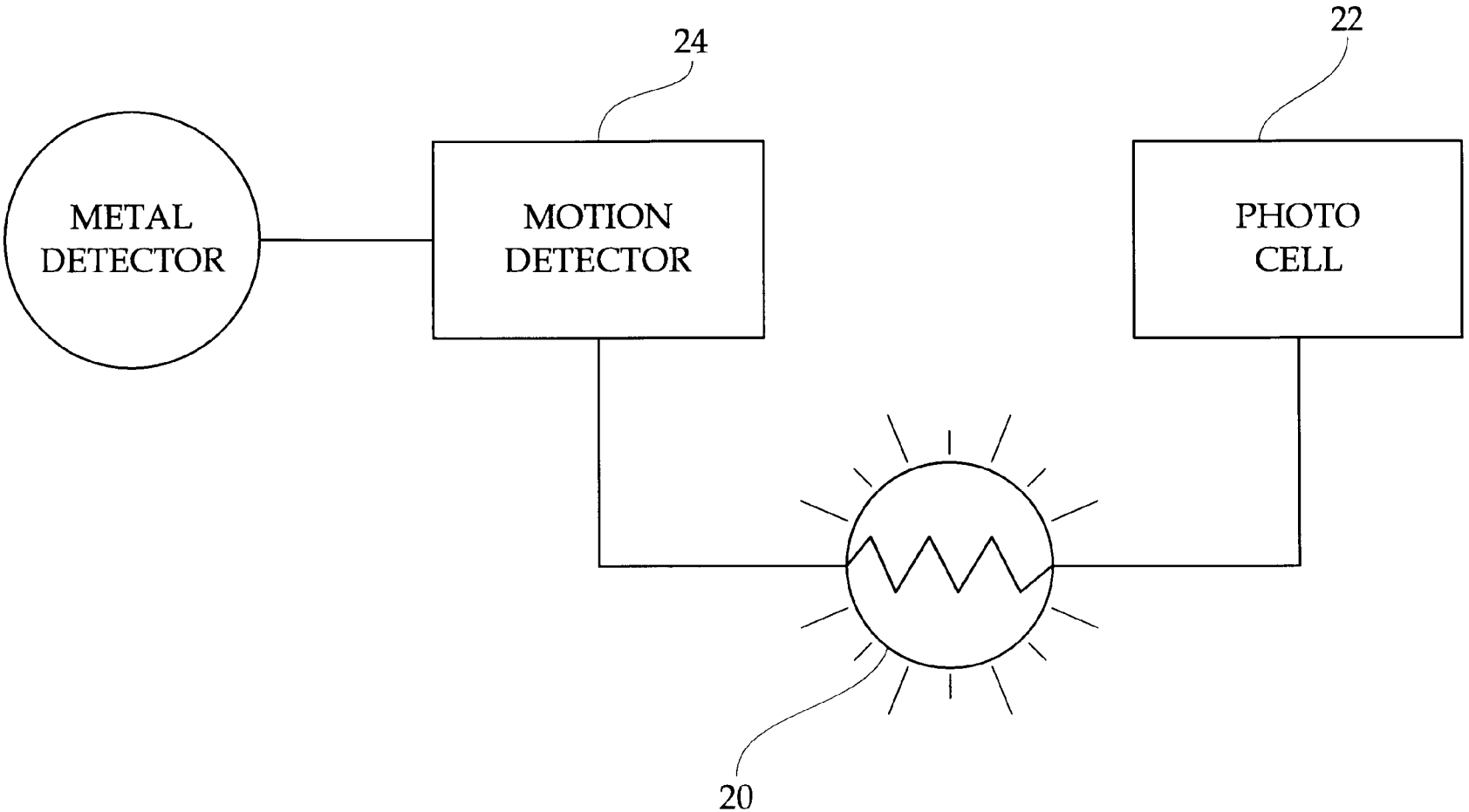
FIG. 3 is a schematic illustration of the operation of the present invention.

With reference now to the drawings, and in particular, to FIGS. 1 through 3 thereof, the preferred embodiment of the new and improved illuminatable traffic sign embodying the principles and concepts of the present invention and generally designated by the reference number 10 will be described.

Specifically, it will be noted in the various Figures that the device relates to an illuminatable traffic sign for lighting a traffic sign at night and upon the approach of a vehicle. In its broadest context, the device consists of a traffic sign, a plurality of lights, a photo cell, and a radar sensor. Such components are individually configured and correlated with respect to each other so as to attain the desired objective.

The traffic sign 12 is secured to a support post 14. FIG. 1 illustrates the traffic sign 12 in the form of a stop sign. FIG. 2 illustrates the traffic sign 12 in the form of a yield sign. Any other type of traffic sign could be utilized, with these two signs being merely illustrative of the numerous possible applications. The traffic sign 12 has indicia 16 disposed thereon. The indica 16 in FIG. 1 is "STOP", while the indicia 16 in FIG. 2 is "YIELD". The traffic sign 12 has an outer periphery 18.

The plurality of lights 20 are positioned on the traffic sign 12 along the outer periphery 18 and outlining the indicia 16 thereof. The plurality of lights 20 will sere to fully illuminate the traffic sign 12 so that is can be clearly noticed at night and will be better noticed during the daytime hours. The plurality of lights 20 will be powered by a power source, either portable or permanent.

The photo cell 22 is disposed within the traffic sign 12. The photo cell 22 is in communication with the plurality of lights 20. The photo cell 22 will activate the lights 20 once a predetermined degree of darkness has been reached. Once a predetermined degree of lightness has been reached, the photo cell 22 will subsequently deactivate the lights 20.

The radar sensor 24 is disposed within the traffic sign 12. The radar sensor 24 is in communication with the plurality of lights 20. The radar sensor 24 is equipped with a metal detecting system. The radar sensor 24 will cause the activation of the lights 20 upon the approach of a vehicle when the lights 20 are not already lit because of darkness. The metal detecting system will prevent the activation of the lights 20 when non-metal objects, such as animals, approach.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An illuminatable traffic sign for lighting a traffic sign at night and upon the approach of a vehicle comprising, in combination:

a traffic sign secured to a support post, the traffic sign having indicia disposed thereon, the traffic sign having an outer periphery;

a plurality of lights positioned on the traffic sign along the outer periphery and outlining the indicia thereof;

a photo cell disposed within the traffic sign, the photo cell being in communication with the plurality of lights;

a radar sensor disposed within the traffic sign, the radar sensor being in communication with the plurality of lights, the radar sensor being equipped with a metal detecting system.

2. The illuminatable traffic sign as set forth in claim 1 wherein the traffic sign is a stop sign.

3. The illuminatable traffic sign as set forth in claim 1 wherein the traffic sign is a yield sign.

* * * * *